US005211807A

United States Patent [19]

Yee

[11] Patent Number: 5,211,807

[45] Date of Patent: May 18, 1993

[54] TITANIUM-TUNGSTEN ETCHING SOLUTIONS

[75] Inventor: Ian Y. K. Yee, Austin, Tex.

[73] Assignee: Microelectronics Computer & Technology Company, Austin, Tex.

[21] Appl. No.: 724,690

[22] Filed: Jul. 2, 1991

[51] Int. Cl.[5] ..... C23F 1/00

[52] U.S. Cl. ..... 156/664; 252/79.1; 252/79.5

[58] Field of Search ..... 252/79.5, 79.1; 156/664

[56] References Cited

U.S. PATENT DOCUMENTS

| | | | |
|---|---|---|---|
| 2,566,615 | 9/1951 | Keilholtz et al. | 156/664 X |
| 2,876,144 | 3/1959 | Bomberger et al. | 156/664 X |
| 3,468,774 | 9/1969 | Kendall | 156/664 X |
| 3,601,666 | 8/1971 | Leedy | 371/234 |
| 4,331,476 | 5/1982 | Helderman et al. | 75/214 |
| 4,410,396 | 10/1983 | Sommers et al. | 156/664 |
| 4,486,946 | 12/1984 | Jopke, Jr. et al. | 29/590 |
| 4,491,860 | 1/1985 | Lim | 357/68 |
| 4,671,852 | 6/1987 | Pyke | 156/652 |
| 4,711,701 | 12/1987 | McLevige | 437/41 |
| 4,740,485 | 4/1988 | Sharpe-Geisler | 437/246 |
| 4,782,032 | 11/1988 | Geisberger et al. | 437/41 |
| 4,787,958 | 11/1988 | Lytle | 156/652 |
| 4,814,429 | 3/1989 | Van Oekel | 437/192 |
| 4,849,376 | 7/1989 | Balzan et al. | 437/228 |
| 4,880,708 | 11/1989 | Sharma et al. | 428/620 |
| 4,927,505 | 5/1990 | Sharma et al. | 204/34.5 |

OTHER PUBLICATIONS

Shankoff et al, "High Resolution Tungsten Patterning Using Buffered, Mildly Basic Etching Solutions," Journal of the Electrochemical Society, vol. 122, No. 2, (Feb. 1975) pp. 294–298.

Nowicki et al, "Studies of the Ti–W/Au Metallization on Aluminum," Thin Solid Films, vol. 53 (1978), pp. 195-200.

Denning et al, "Reliability of High Temperature I2L Integrated Circuits," IEEE/IRPS Proc. 1984, International Reliability Physics Symposium, pp. 30–36.

Meyer et al, "Metallurgy of TiW/Au/Cu System from TAB Assembly," Journal of Vacuum Science Technology, May/Jun. 1985, pp. 772–776.

*Primary Examiner*—Thi Dang

*Attorney, Agent, or Firm*—Fulbright & Jaworski

[57] ABSTRACT

Etchant solutions for titanium-tungsten, which include at least one oxidizing agent and at least one fluoride salt. Also disclosed is a method for etching TiW utilizing these etchants.

23 Claims, No Drawings

TITANIUM-TUNGSTEN ETCHING SOLUTIONS

BACKGROUND OF THE INVENTION

The present invention relates to improved solutions for etching titanium-tungsten mixtures, and nitrogen-stuffed versions and sandwich layers of same. More particularly, the present invention relates to improved etchants which include at least one oxidizing agent and one fluoride salt.

Titanium-tungsten (TiW) is a well-known adhesion and diffusion barrier. It is commonly used as a barrier metal to prevent cross-diffusion of aluminum with either silicon or gold. These materials find particular utility in integrated circuit fabrication. Nitrogen stuffed versions of titanium-tungsten mixtures (TiW(N)) are even better diffusion barriers and are oftentimes produced by reactively sputtering or depositing titanium and tungsten under a partial pressure of nitrogen. A third titanium-tungsten barrier layer consists of a combination or sandwich of layers, typically TiW-TiW(N)-TiW.

Articles which describe the use of TiW include "Studies of the Ti-W/Au Metallization on Aluminum," *Thin Solid Films*, Vol. 53, 1978, pp. 195–200. The use of TiW in chip interconnect metallization is described in "Reliability of High Temperature I2L Integrated Circuits," *IEEE/IRPS Proc.* 1984, *Intl. Rel. Phys. Symp.*, pp. 30–36. The use of TiW for TAB (tape-automated-bonding) wafer bumping is described in "Metallurgy of TiW/Au/Cu System for TAB Assembly," *J. Vac. Sci. Technol.*, May/June 1985, pp. 772–76. In addition, U.S. Pat. Nos. 4,927,505 and 4,880,708 describe the use of TiW and TiW(N) as an adhesion and barrier metallization for TAB wafer bumping. U.S. Pat. No. 4,486,946 describes the use of TiW as a barrier in silicon semiconductor processing of NPN devices. These references are incorporated herein by reference.

Equally well-known, however, is that titanium-tungsten is very difficult to etch due to the different chemical properties of the two metals. Especially difficult to etch is the combination of layers (TiW-TiW(N)-TiW). This is because of the different etch rates of the layers. This difficulty is detrimental in many applications since it may lead to undercutting of patterns, i.e., excessive removal of material in the horizontal or lateral direction which reduces the size of the patterns.

One method of etching involves the use of a dry etch using flourine-based gases. U.S. Pat. No. 4,782,032 describes a process for making field-effect transistors using TiW(N) as the barrier metal. That reference describes the use of a flourine-based plasma in patterning the film. U.S. Pat. No. 4,849,376 describes the use of a dry etch process which uses flourine-based gas as an etchant for TiW in the fabrication of GaAs field-effect transistors.

Dry etchants find particular utility when precise etching is required. Dry etching, however, is expensive due to the high capital cost of reaction ion etch (RIE) systems and are limited in application because they require a hard mask of nickel, aluminum or gold for RIE patterning. Further, for TiW(N), dry etching is difficult to do, especially if selectivity is desired over silicon, silicon oxide, or silicon nitride.

Another etching method involves wet chemical etching. Numerous wet etchants, many of which are commercially available, exist for etching titanium and tungsten individually. In contrast, however, to date, only two wet etchants have been identified that remove mixtures of titanium and tungsten. The most commonly used etchant for TiW is hydrogen peroxide, $H_2O_2$. U.S. Pat. Nos. 4,814,293 and 4,787,958 disclose hydrogen peroxide etching solutions for TiW. Similar teachings are found in U.S. Pat. Nos. 4,740,485; 4,491,860 and 4,711,701. These etchants, however, remove TiW(N) poorly and slowly. In addition, the shortcomings of the etchants are particularly evident when TiW-TiW(N)-TiW sandwiches are used since the differential etch rates among the layers cause severe undercutting of masked patterns. Also, these $H_2O_2$ etchants generally have short shelf-lifes and use-lifes since they are known to decompose readily.

The present inventor previously discovered that additions of ammonium hydroxide, $NH_4OH$, to hydrogen peroxide accelerates the etching of TiW(N) at a higher rate of increase compared to TiW, and precise mixtures of $H_2O_2$ and $NH_4OH$ can be used to match the etch rate of both TiW and TiW(N). This approach, however, requires precise control of the nitrogen contents in TiW(N) and the concentrations of $H_2O_2$ and $NH_4OH$, since small variations in either have significant, potentially negative influences on the etching ability of the solutions.

Another chemical system that removes TiW and TiW(N) is a solution of nitric acid and hydrofluoric acid, $HNO_3$-HF. This system can etch both TiW and TiW(N) quickly and cleanly; however, its use in integrated circuit manufacturing is undesirable since it attacks silicon, silicon oxide, silicon nitride and aluminum.

The present inventor also previously discovered that the addition of isoctylpolyethoxyethanols, such as nonoxynol-9 and -10, mixed in 1 part HF, 10 part $HNO_3$ and 25 part water reduces the attack of these acids on silicon and its compounds; however, its attack of aluminum is not deterred. Thus, the $HNO_3$-HF system has little use as a nondestructive etchant for TiW or TiW(N).

Accordingly, there exists the need for an improved etchant solution for TiW, TiW(N), and combination layers thereof.

SUMMARY OF THE INVENTION

It is, therefore, an object of the present invention to provide an improved etchant solution for TiW and TiW(N), whether mixed, nitrogen-stuffed or layered.

Another object of the present invention is to provide an etchant solution which results in minimal undercutting.

A further object of the invention is to provide an etchant that is sufficiently selective to both TiW and TiW(N), and that does not attack materials common to integrated circuits, such as silicon, silicon oxides and nitrides, aluminum and gold.

Also, it is an object of the present invention to provide an etchant for TiW and TiW(N) that has a long, stable shelf-life and use-life.

Thus, in accordance with one aspect of the present invention, there is provided an etchant for etching titanium-tungsten mixtures and alloys and layered combinations of same, comprising an oxidizing agent and a fluoride salt. In addition the etchant may include a buffering agent. Preferably, the oxidizing agent is ammonium persulfate or potassium ferricyanide. Also, preferably the fluoride salt is a soluble fluoride such as ammonium fluoride or potassium fluoride. The buffer preferably has a positive ion that is the same as the positive ion of the oxidizing agent.

In a preferred embodiment, the etchant solution includes about 150–200 g/L of ammonium persulfate, about 60–70 g/L of ammonium fluoride and about 32–40 g/L of ammonium hydroxide, and has a pH of about 8.5–9.

In another preferred embodiment, the etchant solution comprises about 25–45 g/L of potassium ferricyanide, about 10–15 g/L of potassium hydroxide, about 30–40 g/L of potassium phosphate monobasic and about 60–80 g/L of ammonium fluoride.

In accordance with another aspect of the present invention, there is provided a method for etching TiW which comprises the step of applying an etching solution to TiW, wherein the solution comprises at least one oxidizing agent and at least one fluoride salt.

The present etchants have a long, stable shelf-life and use-life, are selective to TiW and TiW(N), without attacking other materials common to integrated circuits, and produce only minimal undercutting.

These and other objects, features and advantages of the present invention will be further described in the detailed description of preferred embodiments which follows.

DETAILED DESCRIPTION OF PREFERRED EMBODIMENTS

The etchant solutions of the present invention include an oxidizing agent and a fluoride salt. The oxidizing agent is selected from the group of oxidizers which oxidize both titanium and tungsten. Preferred oxidizers include ammonium persulfate and potassium ferricyanide. The selection of the fluoride salt depends upon the environment in which the TiW exists. If the TiW is present on passive devices, such as copper polyimide film, any number of fluoride salts will work as long as they are soluble. However, if the TiW is present on active devices, such as metal-oxide semiconductor (MOS) transistors, then fluoride salts without alkali metal ions are preferred. Particularly preferred is ammonium fluoride. The etchant may also include a buffering agent. This buffer maintains the desired pH of the etch solution. Under normal conditions, titanium and its oxides are most soluble when the pH is below 1 and are practically insoluble at higher values. With the presence of fluorides the solubility range of titanium can be increased to approximately 9. However, tungsten and its oxides are most soluble when the pH is above 7, and become practically inert at low pH values. Thus, a buffering agent can stabilize the etchant's pH between approximately 7 to 9.

Of particular interest are two chemical formulations. The first formulation comprises ammonium persulfate, $(NH_4)_2S_2O_8$; ammonium fluoride, $NH_4F$; and ammonium hydroxide $(NH_4)OH$. More particularly, the etchant solution includes about 150–200 g/L of ammonium persulfate; about 60–70 g/L of ammonium fluoride and about 32–40 g/L of ammonium hydroxide. The ammonium persulfate oxidizes both titanium and tungsten, and the fluoride ions in solution assist in the dissolution of these oxides. If no hydroxide is added and the solution is used near a pH of 7, the solution etches isotropically. With the addition of ammonium hydroxide, the dissolution rate of tungsten oxide is enhanced, while the dissolution rate of titanium oxide is reduced. Thus, an enrichment of titanium oxide occurs during the etching, especially at the base or foot of masked patterns where hydrodynamic solution flow is small. This enrichment of titanium oxide at the base and sidewalls of the pattern limits the amount of undercut.

The second formulation comprises potassium ferricyanide, $K_3Fe(CN)_6$; potassium hydroxide, KOH; potassium phosphate monobasic, $KH_2PO4$; and ammonium fluoride, NH4F. Preferably the aqueous solution includes about 25–45 g/L of potassium ferricyanide, about 10–15 g/L of potassium hydroxide, about 30–40 g/L of potassium phosphate monobasic and about 60–80 g/L of ammonium fluoride. In this formulation, the $K_3Fe(CN)_6$ oxidizes both tungsten and titanium. The KOH and $KH_2PO_4$ form a buffered solution of about pH 8.5 for maintaining safe operating conditions of the ferricyanide and also assist in the dissolution of the tungsten oxide. The $NH_4F$ assists in the dissolution of the titanium oxide. This solution also yields limited undercut, even with extended over-etch, due to the enrichment of titanium oxide at the base of patterned features.

The above etchants can be used in either conventional immersion etch baths or spray etch systems. In addition, a brief post-treatment chemical dip after etching can remove titanium oxide skin at the pattern sidewalls (since the reduced undercut is attributable to the titanium enrichment at the sidewalls). For instance, the wafers can be rinsed in water and dipped for 15 seconds in a dilute solution of 0.25 wt. % HF with about 0.05% non-ionic surfactant such as Triton N-101 or Triton X-100. Alternatively, the wafers can be rinsed in water and dipped for 30 seconds in 10% hydrogen peroxide. Furthermore, these post-treatments fail to attack silicon or silicon compounds at any appreciable rate and have been shown to be compatible with integrated circuit processes.

The following non-limiting examples were actually performed, tested and evaluated. These examples are meant to illustrate and not to limit the invention, the scope of which is defined solely by the appended claims.

EXAMPLE 1

An etchant was prepared by mixing 150 grams of ammonium persulfate, 160 ml of a 40 wt. % aqueous solution of $NH_4F$, 70 ml of a 29 wt. % aqueous solution of $NH_3$, and sufficient water to make a 1,000 ml solution. Wafers containing TiW, TiW(N) or combinations thereof were immersed in a tank containing this solution. Good solution agitation was helpful in obtaining uniform etch results, as is true for all immersion etching processes. Alternatively, wafers could be etched in a spray etching system using this solution. When immersion type etching was used, the etch time for composite layers consisting of 500 angstroms TiW, 7500 angstroms TiW(N) and 750 angstroms TiW masked with a patterned gold mask such as a tape-automated-bonding gold bump was about 10 minutes. Of course, the etch time will depend on the type of TiW or TiW(N) used, but the advantage of the etch formulations described herein is that one can over-etch without substantially undercutting the patterns. After etching, the wafers were rinsed thoroughly in water and dipped briefly for 15 seconds in 0.25 wt. % HF solution containing 0.05% Triton N-101. The wafers were rinsed again in water and dried. An undercut of 2–3 microns was typical. In contrast, etching with hydrogen peroxide/ammonium hydroxide under excellent conditions undercut approximately 5–10 microns.

EXAMPLE 2

Another etchant was prepared by mixing 35 grams $KH_2PO_4$, 14 grams KOH, 35 grams $K_3Fe(CN)_6$, 160 ml of 40 wt. % aqueous solution $NH_4F$, and sufficient water to make a 1,000 ml solution. The etchant could pattern TiW or TiW(N) films with either a gold hard mask or a photoresist mask. Wafers containing composite layers consisting of 500 angstroms TiW, 7500 angstroms TiW(N) and 750 angstroms TiW were immersed in the etchant and etched in 15 minutes. After etching, the wafers were rinsed thoroughly in water and immersed briefly for 15 seconds in 0.25 wt. % HF solution containing 0.05% Triton N-101. The wafers were again rinsed in water and dried. The undercut was approximately 1–2 microns.

The formulation of Example 1 has the advantage that it is a non-cyanide based solution and does not contain alkali metal ions. The formulation of Example 2 has the advantage of better stability and etch consistency due to lower dependency on the type of TiW and TiW(N) used.

The present invention, therefore, is well adapted to carry out the objects and attain the ends and advantages mentioned, as well as others inherent therein. While presently preferred embodiments of the invention have been described for the purpose of disclosure, the numerous change in the compositions and materials selection may be made without departing from the spirit of the present invention and the scope of the appended claims.

What is claimed is:

1. A method for etching TiW, comprising the steps of applying an etchant solution to TiW, wherein said solution comprises at least one oxidizing agent and at least one fluoride salt, and buffering the solution to maintain a pH in the range of approximately 7 to 9.

2. The method of claim 1 wherein the etching solution is applied by immersion in an etch bath.

3. The method of claim 1 wherein the etching solution is applied by a spray etch system.

4. A method for etching TiW, comprising the step of applying an etching solution to TiW, wherein said solution comprises potassium ferricyanide and a fluoride salt.

5. An etchant for etching titanium-tungsten mixtures and alloys and layered combinations of same, comprising potassium ferricyanide and a fluoride salt.

6. An etchant as claimed in claim 5, further comprising a buffering agent.

7. An etchant as claimed in claim 5, wherein said fluoride salt is soluble.

8. An etchant as claimed in claim 7, wherein said fluoride salt is ammonium fluoride.

9. An etchant as claimed in claim 7, wherein said fluoride salt is potassium fluoride.

10. An etchant as claimed in claim 6, wherein said buffer comprises a positive ion common to said oxidizing agent.

11. An etchant for etching titanium-tungsten mixtures and alloys and layered combinations of same, comprising ammonium persulfate, ammonium fluoride and ammonium hydroxide.

12. An etchant as claimed in claim 11, wherein the solution includes about 150–200 g/L of ammonium persulfate, about 60–70 g/L of ammonium fluoride and about 32–40 g/L of ammonium hydroxide.

13. An etchant as claimed in claim 12, wherein the pH of the solution ranges from about 8.5 to 9.

14. An etchant for etching titanium-tungsten mixtures and alloys and layered combinations of same, comprising potassium ferricyanide, potassium hydroxide, potassium phosphate monobasic and ammonium fluoride.

15. An etchant as claimed in claim 14, wherein the solution comprises about 25–45 g/L of potassium ferricyanide, about 10–15 g/L of potassium hydroxide, about 30–40 g/L of potassium phosphate monobasic and about 60–80 g/L of ammonium fluoride.

16. An etchant for etching titanium-tungsten mixtures and alloys and layered combinations of same, comprising an oxidizing agent, a fluoride salt, and a buffering agent to maintain a pH in the range of approximately 7 to 9.

17. An etchant as claimed in claim 16, wherein said oxidizing agent is ammonium persulfate or potassium ferricyanide.

18. An etchant as claimed in claim 17, wherein said oxidizing agent is ammonium persulfate.

19. An etchant as claimed in claim 17, wherein said oxidizing agent is potassium ferricyanide.

20. An etchant as claimed in claim 16, wherein said fluoride salt is soluble.

21. An etchant as claimed in claim 20, wherein said fluoride salt is ammonium fluoride.

22. An etchant as claimed in claim 20, wherein said fluoride salt is potassium fluoride.

23. An etchant as claimed in claim 16, wherein said buffer comprises a positive ion common to said oxidizing agent.

* * * * *